US009255761B2

(12) United States Patent
Rentz

(10) Patent No.: US 9,255,761 B2
(45) Date of Patent: Feb. 9, 2016

(54) ROPE LOCKING DEVICE

(71) Applicant: Gregory E. Summers, Amherst, VA (US)

(72) Inventor: Marc T. Rentz, Madison Heights, VA (US)

(73) Assignee: Gregory E. Summers, Amherst, VA (US)

( * ) Notice: Subject to any disclaimer, the term of this patent is extended or adjusted under 35 U.S.C. 154(b) by 34 days.

(21) Appl. No.: 14/141,874

(22) Filed: Dec. 27, 2013

(65) Prior Publication Data

US 2015/0184975 A1 Jul. 2, 2015

(51) Int. Cl.
*F41B 5/18* (2006.01)
*F41B 5/14* (2006.01)

(52) U.S. Cl.
CPC ..... *F41B 5/1469* (2013.01); *Y10T 24/39* (2015.01); *Y10T 24/3969* (2015.01); *Y10T 24/3973* (2015.01); *Y10T 24/3996* (2015.01)

(58) Field of Classification Search
CPC ... F41B 5/1469; Y10T 24/3969; Y10T 24/39; Y10T 24/3918; Y10T 24/3996; Y10T 24/3916; Y10T 24/3971; Y10T 24/3973
USPC ..... 124/35.2
See application file for complete search history.

(56) References Cited

U.S. PATENT DOCUMENTS

| | | | | | |
|---|---|---|---|---|---|
| 2,200,895 | A * | 5/1940 | Rio | 24/712.5 |
| 2,443,335 | A * | 6/1948 | Vogel | A45C 13/1046 24/136 L |
| 2,828,147 | A * | 3/1958 | Peiffer | 285/421 |
| 4,141,117 | A * | 2/1979 | Van Gompel | 24/136 R |
| 4,249,507 | A * | 2/1981 | Marra | 124/35.2 |
| 4,455,717 | A * | 6/1984 | Gray | 24/115 R |
| 4,615,532 | A * | 10/1986 | Biller et al. | 279/32 |
| 4,877,009 | A * | 10/1989 | Becker | 124/35.2 |
| 4,982,718 | A * | 1/1991 | Hamm et al. | 124/35.2 |
| 6,086,608 | A * | 7/2000 | Ek et al. | 606/232 |
| 6,260,241 | B1 * | 7/2001 | Brennan | 24/135 R |
| 6,475,230 | B1 * | 11/2002 | Bonutti et al. | 606/232 |
| 6,481,431 | B1 * | 11/2002 | Summers | 124/35.2 |
| 8,336,746 | B2 * | 12/2012 | Leach | 224/257 |
| 2013/0145583 | A1 * | 6/2013 | Ortiz | H02G 9/06 24/136 L |

* cited by examiner

*Primary Examiner* — Robert J Sandy
*Assistant Examiner* — Louis Mercado
(74) *Attorney, Agent, or Firm* — Leading-Edge Law Group, PLC

(57) ABSTRACT

A rope locking device which cooperates with the yoke on an archery wrist strap is used to lock a rope which connects an archery release with the wrist strap. The locking device includes a generally cylindrical body portion having a longitudinal axis and a contoured outer surface. At one end of the body portion is a head portion containing a pair of openings for receiving the rope. The rope passes through the openings and along the contoured outer surface of the locking device body portion. When the locking device is wedged into an opening in the yoke, the rope is cinched between the locking device and the yoke to lock the rope in place.

13 Claims, 1 Drawing Sheet

ROPE LOCKING DEVICE

BACKGROUND OF THE INVENTION

In order to increase the accuracy of an archery shot, a release is often used to release the string on a bow. A release provides a smoother release of the string than is available by manually pulling the string back with the fingers and then releasing the string from the fingers.

Releases are often connected with a wrist strap worn by the archer. A rope is used to tie the release to the strap. It is often necessary to change the distance of the release relative to the strap, thus requiring untying the rope and retying it with the release at the proper position. The tying and untying of the release is both time consuming and cumbersome.

The present invention was developed in order to provide a device for quickly and efficiently locking and releasing the rope used to connect a release to a wrist strap for adjustment to suit the needs of an archer.

SUMMARY OF THE INVENTION

Accordingly, it is a primary object of the invention to provide a rope locking device that has a generally cylindrical body portion with a longitudinal axis and a contoured outer surface. The device further includes a head portion arranged at one end of the body portion. The head portion has a greater diameter than the body portion and contains first and second through openings on opposite sides of the body portion for receiving a length of rope. When the cylindrical body portion of the locking device is inserted into a yoke, the rope is pressed by the contoured body portion against the yoke to lock the rope in place. The rope is released by tugging on the free end of the rope to pull the locking device out of the yoke.

The contoured outer surface of the cylindrical body portion preferably includes a pair of concave surfaces arranged on opposite sides of the body portion in alignment with the first and second openings. A preferred contoured surface is defined by a plurality of steps of different depths.

The end of the cylindrical body portion opposite the head end is tapered and includes concave surfaces aligned with the contoured surfaces of the body portion.

BRIEF DESCRIPTION OF THE FIGURES

Other objects and advantages of the invention will be become apparent from a study of the following description when viewed in the light of the accompanying drawing, in which.

DETAILED DESCRIPTION

Figure 1:
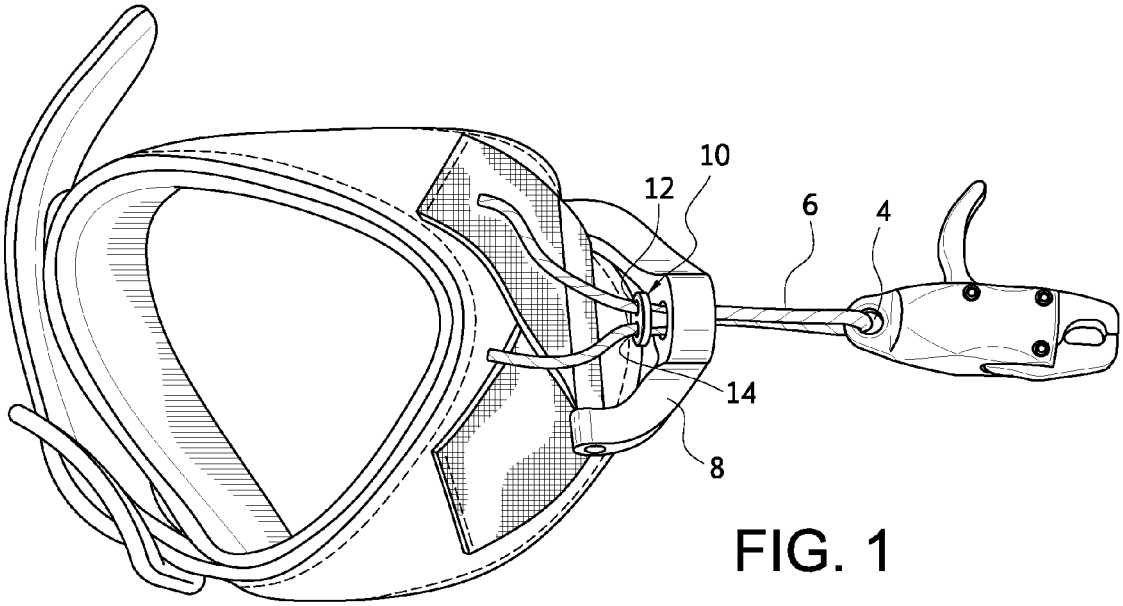
FIG. 1 is a perspective view of the locking device according to the invention used to connect an archery release to a wrist strap.
Figure 3:
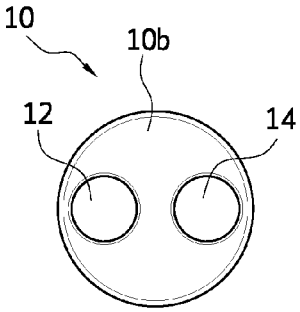
FIGS. 3-5 are left side, front, and right side plan views, respectively, of the locking device of FIG. 2.
Figure 4:
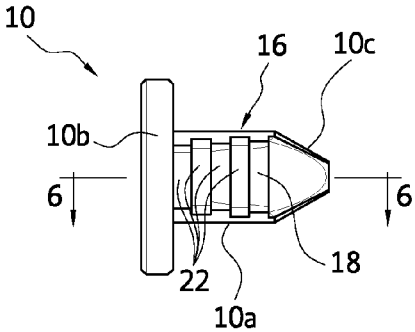

Referring first to FIG. 1, there is shown a wrist strap 2 with which an archery release 4 is connected via a rope 6. A yoke 8 is connected with the wrist strap and the rope passes through an opening in the yoke. A locking device 10 according to the invention is used to lock the rope within the yoke opening as will be developed in greater detail below.

Figure 5:
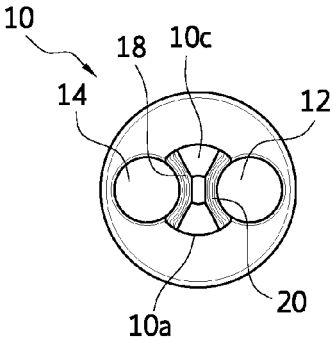
Figure 2:
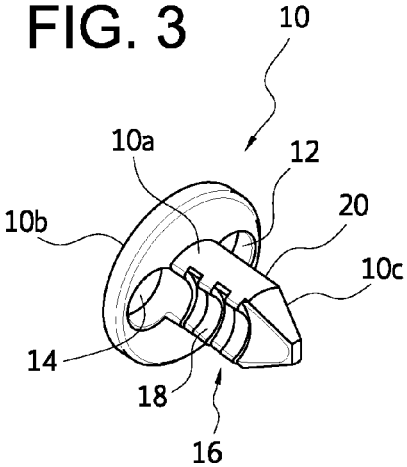
FIG. 2 is a perspective view of the locking device of FIG. 1.

Turning now to FIGS. 2-6, the locking device 10 will be described in greater detail. The locking device includes a cylindrical body portion 10*a*, a head portion 10*b* at one end, and a tapered portion 10*c* at the other end. The head portion has a greater outer diameter than the outer diameter of the body portion and contains first 12 and second 14 through-openings. The cylindrical body portion contains a contoured outer surface 16. Preferably, the contoured outer surface includes two contoured portions 18 and 20 which are arranged on opposite sides of the cylindrical body portion in alignment with the first and second openings as shown in FIGS. 2 and 5.

Figure 6:
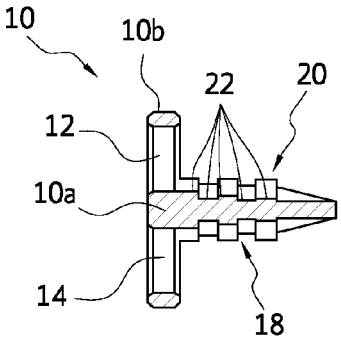
FIG. 6 is a sectional view of the locking device taken along line 6-6 of FIG. 4.

The contoured portions 18 and 20 each have a concave configuration and the contours are defined by a plurality of steps 22 which are arranged longitudinally of the cylindrical body portion and extend laterally within each concavity as shown in 2. In a preferred embodiment as best shown in FIG. 6, the depths of the steps alternately increase and decrease along the length of the cylindrical body portion.

The tapered end portion 10*c* of the locking device also contains concave portions 24 and 26 which are aligned with the first 12 and second 14 openings of the head portion and with the contoured portions 18 and 20 of the cylindrical body portion.

In operation, the rope 6 is passed through the first opening 12 in the head portion of the locking device 10, through the opening in the yoke 8, through an opening in the release 4, back through the opening in the yoke, and through the second opening 14 in the head portion of the locking device. The rope extends along the contoured portions 18, 20 of the cylindrical body portion of the locking device. The length of the rope protruding from the yoke, and thus the distance of the release from the yoke is adjusted. When the length has been set, a quick pull or tug on the release or on the rope portions between the release and the yoke draws the locking device cylindrical body portion into the yoke opening to wedge the device in the yoke and cinch the rope between the contoured portions and the inner wall surface of the yoke. In order to release the locking device, a quick pull or tug on the free ends of the rope will disengage the locking device from the yoke so that the locking device may be removed, thus allowing the rope move freely through the yoke for adjustment.

The device will operate satisfactorily without the contoured surfaces in the concave portions of the cylindrical body portion of the locking device. However, the contoured surface helps to grip the rope when the locking device is wedged into the yoke opening. The rope preferably has a diameter so that the rope outer surface fits within the contoured portions 18 and 20 of the locking device.

The yoke and locking device are preferably formed of a relative rigid material with a limited degree of flexure such as synthetic plastic. Such a material enables the locking device cylindrical portion to be wedged into the opening of the yoke so that it cannot be removed without exerting a certain degree of force which can be applied by a quick tug on the free end of the rope. Similarly, the locking device is wedged into yoke by a quick tug on the release.

While the preferred forms and embodiments of the invention have been illustrated and described, it will be apparent to those of ordinary skill in the art that various changes and modifications may be made without deviating from the inventive concepts set forth above.

What is claimed is:

1. A rope locking device, comprising:

(a) a body portion having a longitudinal axis and a contoured outer surface including a pair of longitudinally extending concave surfaces arranged on opposite sides of said body portion, each concave surface containing a plurality of steps extending normal to said longitudinal axis and continually between opposed edges of each concave surface; and (b) a head portion arranged at one end of said body portion, said head portion having a width greater than a width of said body portion and containing first and second through-openings for receiving a length of rope, said first and second through-openings being aligned with said pair of concave surfaces, respectively, whereby when said body portion is inserted into a yoke, said contoured outer surface of said body portion presses the rope against the yoke to lock the rope in place.

2. A rope locking device as defined in claim 1, wherein said steps have different depths.

3. A rope locking device as defined in claim 2, wherein the depths of said steps alternately increase and decrease along said body portion.

4. A rope locking device as defined in claim 1, wherein an end of said body portion opposite said head portion is tapered.

5. A rope locking device as defined in claim 4, wherein said tapered end of said body portion contains a pair of concave surfaces aligned with said longitudinally extending concave surfaces.

6. A rope locking device as defined in claim 1, wherein said body portion has a cylindrical configuration.

7. A locking assembly for a rope which connects an archery release with a strap, comprising:

(a) a yoke connected with the strap, said yoke containing a longitudinal opening for receiving the rope; and (b) a locking device for insertion into said opening in said yoke, said locking device including (1) a body portion having a longitudinal axis and a contoured outer surface including a pair of longitudinally extending concave surfaces arranged on opposite sides of said body portion; and (2) a head portion arranged at one end of said body portion, said head portion having a width greater than a width of said body portion and containing first and second through-openings in alignment with said pair of concave surfaces, respectively, for receiving the rope, the rope passing through said locking device first opening, through said yoke opening, through an opening in the release, back through the yoke opening, and through said locking device second opening, whereby when the release is pulled, the rope cinches the locking device into the yoke opening to lock the rope, and when free ends of the rope are pulled, said locking device is removed from said yoke to release the rove.

8. A locking assembly as defined in claim 7, wherein said longitudinally extending concave surfaces comprise a plurality of steps.

9. A locking assembly as defined in claim 8, wherein said steps have different depths.

10. A locking assembly as defined in claim 9, wherein the depths of said steps alternately increase and decrease along said body portion.

11. A locking assembly as defined in claim 7, wherein an end of said body portion opposite said head portion is tapered.

12. A locking assembly as defined in claim 11, wherein said tapered end of said body portion contains a pair of concave surfaces aligned with said longitudinally extending concave surfaces.

13. A locking assembly as defined in claim 7, wherein said body portion has a cylindrical configuration.

* * * * *